US011122861B2

(12) United States Patent
Tresser

(10) Patent No.: US 11,122,861 B2
(45) Date of Patent: Sep. 21, 2021

(54) HEEL COUNTER

(71) Applicant: Under Armour, Inc., Baltimore, MD (US)

(72) Inventor: Christian Tresser, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 43 days.

(21) Appl. No.: 16/413,680

(22) Filed: May 16, 2019

(65) Prior Publication Data

US 2020/0359745 A1 Nov. 19, 2020

(51) Int. Cl.
*A43B 21/32* (2006.01)
*A43B 21/08* (2006.01)

(52) U.S. Cl.
CPC ..... *A43B 21/32* (2013.01); *A43B 21/08* (2013.01)

(58) Field of Classification Search
CPC ..... A43B 21/08; A43B 21/32; A43B 3/0047
See application file for complete search history.

(56) References Cited

U.S. PATENT DOCUMENTS 2,789,374 A * 4/1957 Planert ..... A43B 3/242 36/71
2,994,972 A * 8/1961 Blair ..... A43B 5/00 36/92
4,245,408 A 1/1981 Larsen et al.
4,510,701 A 4/1985 Schour et al.
4,670,998 A * 6/1987 Pasternak ..... A43B 5/00 36/114
4,811,502 A 3/1989 Barret
5,319,869 A * 6/1994 McDonald ..... A43B 5/00 36/114
5,408,761 A 4/1995 Gazzano
6,367,171 B1 4/2002 Burt
7,168,188 B2 * 1/2007 Auger ..... A43B 3/0047 36/69
9,044,063 B2 6/2015 Loverin et al.
9,095,188 B2 * 8/2015 Cavaliere ..... A43B 21/36
2004/0111921 A1 6/2004 Lenormand
2006/0010718 A1 * 1/2006 Auger ..... A43B 23/088 36/69
2006/0032091 A1 * 2/2006 Kilgore ..... A43B 23/17 36/68

FOREIGN PATENT DOCUMENTS

EP 329392 A2 8/1989

* cited by examiner

*Primary Examiner* — Jila M Mohandesi
(74) *Attorney, Agent, or Firm* — Plumsea Law Group, LLC

(57) ABSTRACT

A heel counter for an article of footwear is disclosed. The heel counter includes an outer frame member and an inner elastic member. The heel counter may also include wing portions that extend up to a lacing region of the article of footwear. The wing portions may have eyelets that can be engaged by a lace. As the lace is tightened, the outer frame member is pulled forward to lock down the foot while the inner elastic member stretches and conforms to the heel to provide increased support.

20 Claims, 8 Drawing Sheets

HEEL COUNTER

BACKGROUND

The present embodiments relate generally to articles of footwear, and in particular to articles of footwear that incorporate heel counters.

Articles of footwear may include a heel counter that is used to reinforce the heel cup of the article of footwear and increase support. Heel counters may cradle the arch of the foot and help limit over-pronation. Heel counters may help keep the foot in place and secured against the midsole of the article of footwear.

SUMMARY

In one aspect, a heel counter for an article of footwear includes an outer frame member and an inner elastic member. The inner elastic member is substantially more elastic than the outer frame member.

In another aspect, an article of footwear includes an upper and a heel counter. The heel counter further includes an outer frame member and an inner elastic member. The inner elastic member is substantially more elastic than the outer frame member.

In another aspect, an article of footwear includes an upper and a lace extending through openings in a lacing region of the upper. The article also includes a heel counter, where the heel counter further includes a rearward portion for receiving a heel, a first wing portion and a second wing portion. The first wing portion includes a first eyelet and the second wing portion includes a second eyelet. The first wing portion extends to the lacing region and the lace extends through the first eyelet. The second wing portion extends to the lacing region and the lace extends through the second eyelet.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
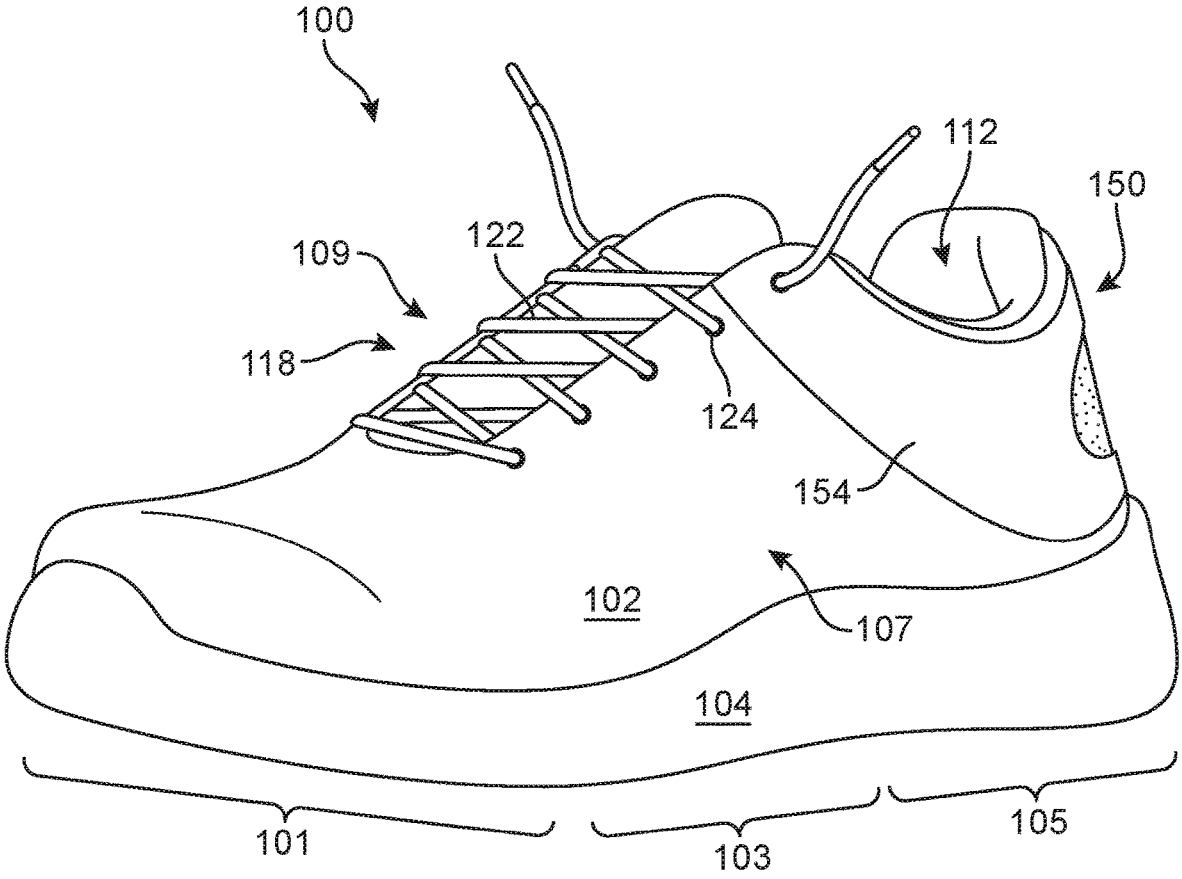
FIG. 1 is a schematic isometric view of an article of footwear, according to an embodiment.

The embodiments provide a heel counter with enhanced support for a foot disposed in an article of footwear. The heel counter may include a relatively inelastic outer frame member that helps to lock a foot in place as well as an inner elastic member that can cup the heel and support it from all sides. The heel counter may also include wing portions that can engage with a fastening system. This allows the heel counter to be tightened against the heel as the article of footwear is fastened. Specifically, as the article of footwear is tightened, the outer frame member of the heel counter is pulled forward, locking the foot in place. Simultaneously, the inner elastic member expands around the heel and supports it on all sides.

In the following detailed description, reference is made to the accompanying figures that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicates that the embodiment described may include a particular feature, structure, or characteristic that may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structure, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

The terms "comprising," "including," "having," and the like, as used with respect to embodiments of the present disclosure, are synonymous.

As used herein, the term "article" refers broadly to articles of footwear, articles of apparel (e.g., clothing), as well as accessories and/or equipment. Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

FIG. 1 is a schematic isometric view of an embodiment of an article of footwear 100, also referred to simply as article 100. For purposes of general reference, as illustrated in FIG. 1, article of footwear 100 may be divided into three regions: forefoot region 101, midfoot region 103, and heel region 105. Forefoot region 101 may be generally associated with the toes and joints connecting the metatarsals with the phalanges. Midfoot region 103 may be generally associated with the arch of a foot, including the instep. Likewise, heel region 105 or "hindfoot" may be generally associated with the heel of a foot, including the calcaneus bone.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

The term "longitudinal," as used throughout this detailed description and in the claims, refers to a direction extending along the length of a component. For example, a longitudinal direction of an article of footwear extends from forefoot region 101 to heel region 105 of article of footwear 100. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between medial side 107 and lateral side 109 of article of footwear 100, with lateral side 109 of the article of footwear 100 being the surface that faces away from the other foot, and medial side 107 being the surface that faces toward the other foot.

Article of footwear 100 may include upper 102 and a sole or "sole structure" 104, which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 100. In some cases, the inner side of an element may have other elements between that inner side and the interior in the completed article of footwear 100. Similarly, an outer side of an element may have other elements between that outer side and the space external to the completed article of footwear 100. Further, the terms "inward" and "inwardly" shall refer to the direction toward the interior of the article of footwear, and the terms "outward" and "outwardly" shall refer to the direction toward the exterior of article of footwear 100.

Upper 102 provides a covering for the wearer's foot that comfortably receives and securely positions the foot with respect to the sole structure. Upper 102 may be made from any suitable material or pluralities of materials including, but not limited to, nylon, cotton, natural leather, synthetic leather, natural rubber, or synthetic rubber. In general, upper 102 includes opening 112 that provides entry for the foot into an interior cavity of upper 102 in heel region 105.

Upper 102 may include lacing system, or lace 122, applied at a fastening region 118 of upper 102. Other embodiments of fastening provisions, include, but are not limited to, laces, cables, straps, buttons, zippers as well as any other provisions known in the art for fastening articles. For a lacing system, the fastening region 118 comprises plurality of eyelets 124. In other embodiments, a fastening region may comprise one or more tabs, loops, hooks, D-rings, hollows, or any other suitable fasteners.

Sole structure 104 is positioned between a foot of a wearer and the ground, and may incorporate various component elements. For example, sole structure 104 may include one or more of inner sole component or "insoles", a middle sole element or "midsole", and an outer sole element or "outsole". An insole may take the form of a sockliner adjacent the wearer's foot to provide a comfortable contact surface for the wearer's foot. It will be understood that an insole may be optional. Further, a midsole may directly serve as a cushion and support for the foot. In addition, an outsole may be configured to contact the ground surface.

Upper 102 and sole structure 104 may be coupled using any conventional or suitable manner, such as adhesion or bonding, via a woven connection, via one or more types of fasteners, etc. Additionally, in some embodiments, sole structure 104 and upper 102 may be combined together in a single unitary construction.

Article 100 may further include a heel counter 150. Heel counter 150 is configured to provide support to the heel of a user's foot. Specifically, heel counter 150 may help to lock the foot in place within article 100 and anchor the foot to sole structure 104. Furthermore, heel counter 150 helps cradle the heel and arch of a foot and may reduce overpronation.

At least some portions of heel counter 150 may be disposed in heel region 105. Also, at least some portions of heel counter 150 may extend through midfoot region 103. As seen in FIG. 1, at least some portions of heel counter 150 may also extend to fastening region 118.

In the exemplary embodiment of FIG. 1, heel counter 150 is disposed on an exterior of upper 102. Alternatively, heel counter 150 could be disposed on an interior of upper 102 (that is, within opening 112). Also, heel counter 150 could be disposed between outer and inner layers of upper 102.

Figure 2:
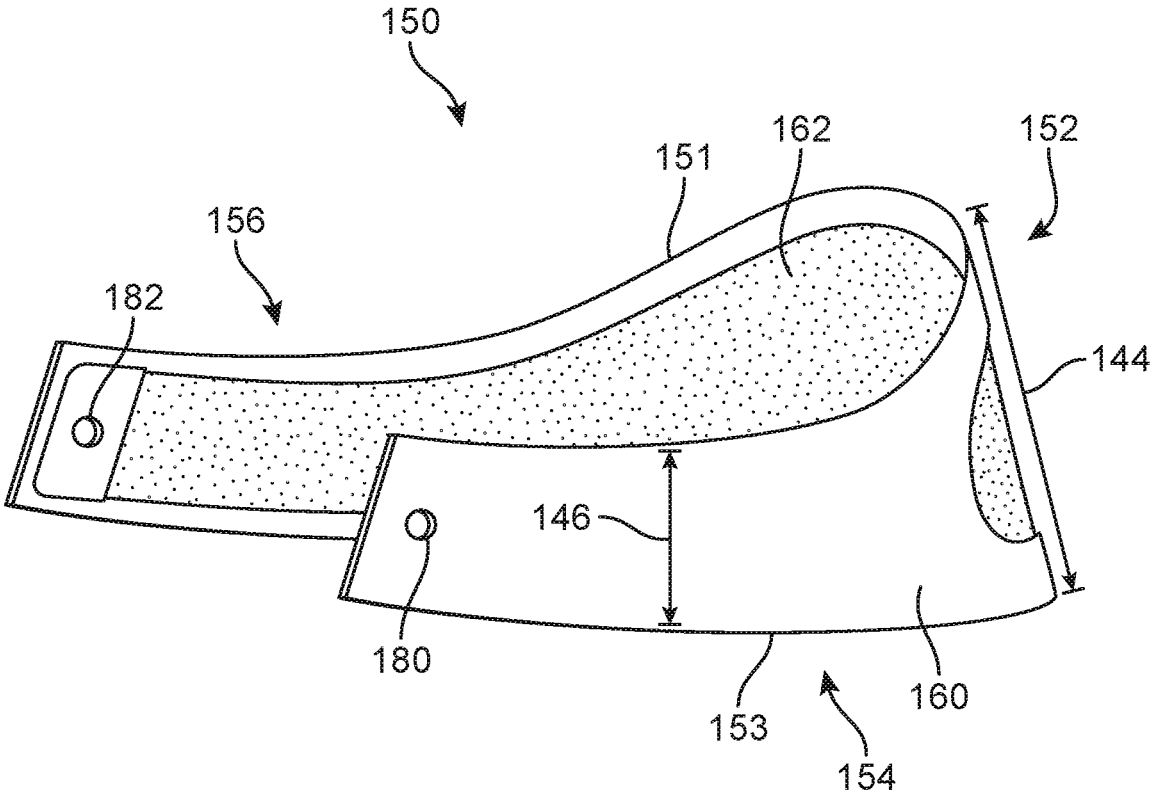
FIG. 2 is a schematic isometric view of an embodiment of a heel counter.
Figure 3:
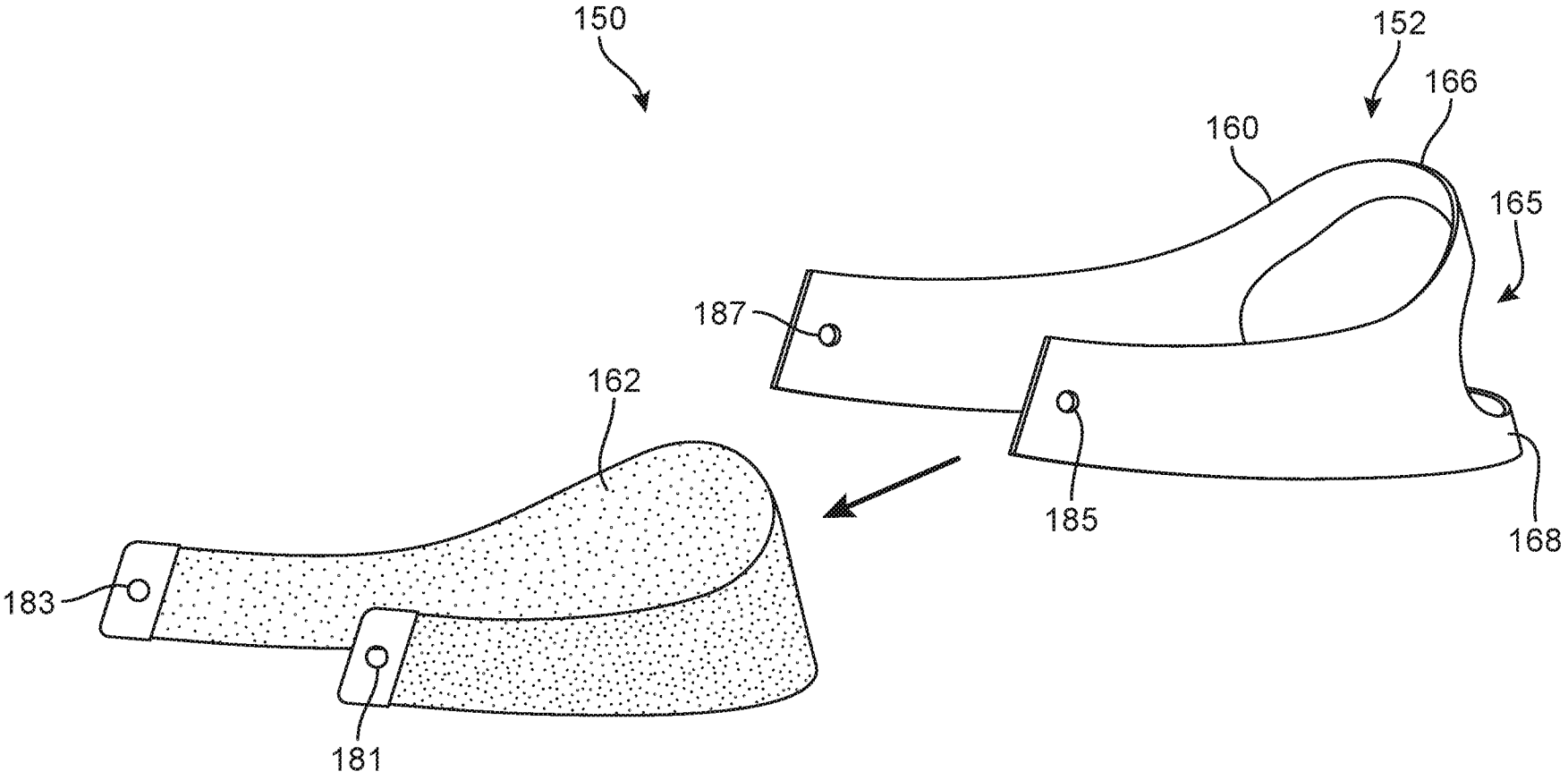
FIG. 3 is a schematic isometric exploded view of the heel counter of FIG. 2.
Figure 4:
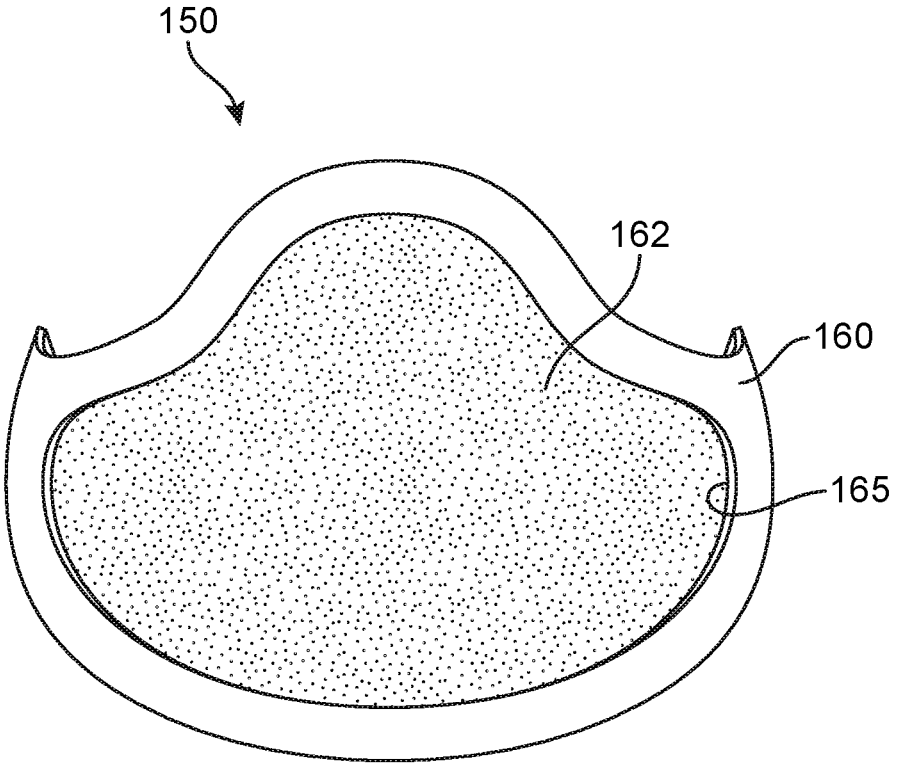
FIG. 4 is a schematic rearward view of the heel counter of FIG. 2.

The structure of heel counter 150 is shown schematically in FIGS. 2-4. Specifically, FIG. 2 depicts a schematic isometric view of heel counter 150, while FIG. 3 depicts a schematic exploded isometric view of heel counter 150. FIG. 4 depicts a rear view of heel counter 150.

Referring to FIG. 2, heel counter 150 may comprise a rearward portion 152, a first wing portion 154 and a second wing portion 156. Rearward portion 152 is configured to engage (or be disposed adjacent to) the heel of a foot, while first wing portion 154 and second wing portion 156 are configured to extend forwards along an article. As seen in FIG. 1, first wing portion 154 and second wing portion 156 may extend to fastening region 118 and engage lace 122, as discussed in further detail below.

The wing portions of heel counter 150 may have a decreased height compared to the rearward portion. As used herein, the height of a heel counter portion refers to a dimension extending between a lowermost edge 153 and an uppermost edge 151 of heel counter 150 (see FIG. 2). Here, lowermost edge 153 is an edge that is disposed closest to a sole structure (for example, sole structure 104). Uppermost edge 151 is an edge that is disposed closest to an upper opening (for example, opening 112).

The height of heel counter 150 may be seen to taper from a maximum height 144 at rearward portion 152 to a minimum height 146 along each of first wing portion 154 and second wing portion 156. This shape allows heel counter 150 to provide maximum support and cradling along the heel of article 100, while providing increased flexibility for first wing portion 154 and second wing portion 156 as they extend forwards towards fastening region 118.

Heel counter 150 may be comprised of at least two members having distinct material properties. As seen in FIGS. 2-3, heel counter 150 includes an outer frame member 160 and an inner elastic member 162. Outer frame member 160 provides a frame-like support for heel counter 150. Inner elastic member 162 may extend along outer frame member 160.

As best seen in FIG. 3, rearward portion 152 may include a cut-out (or opening) 165. Cut-out 165 extends through a substantial majority of rearward portion 152 such that rearward portion 152 is primarily comprised of an upper peripheral portion 166 and a lower peripheral portion 168 separated by cut-out 165. The presence of cut-out 165 may decrease the overall stiffness of rearward portion 152, thereby increasing the flexibility of heel counter 150 along the heel. This may also decrease pressure against the rear side of the heel that would be applied by a solid heel counter.

An outer frame member and an inner elastic member may have approximately similar shapes. For example, in the exemplary embodiment shown in FIGS. 2-3, outer frame member 160 and inner elastic member 162 have similar shapes, though inner elastic member 162 lacks a cut-out. Specifically, both members have a rearward portion and wing portions, where the height tapers from the rearward portion to the wing portions. However, in other embodiments, an inner elastic member may not include wing portions.

Some portions of inner elastic member 162 may be fixed in place on outer frame member 160. For purposes of this disclosure, the term "fixedly attached" shall refer to two components joined in a manner such that the components may not be readily separated (for example, without destroying one or both of the components). For example, the entirety of inner elastic member 162 could be fixedly attached to outer frame member 160. Alternatively, inner elastic member 162 could be fixedly attached to only some portions of outer frame member 160. For example, inner elastic member 162 may only be secured to outer frame member 160 at rearward portion 152 of heel counter 150. More specifically, inner elastic member 162 could be secured to the periphery of cut-out 165. In some cases, inner elastic member 162 may be pre-tensioned before being secured to the periphery of cut-out 165.

As another example, inner elastic member 162 may be secured only to one or both of the wing portions of heel counter 154, but not to rearward portion 152. However, in other cases, inner elastic member 162 may not be secured in place with respect to outer frame member 160, but may be held in place by fasteners, straps, or other layers of material that keep inner elastic member 162 coupled to outer frame member 160.

Any suitable mode of attachment may be used to fix one or more portions of an inner elastic member in place on an outer frame member. Exemplary modes of attachment include adhesives, such as contact adhesives, drying adhesives, polymer dispersion adhesives, pressure sensitive adhesives, and hot-melt adhesives. Other suitable modes of attachment include stitches, staples, Velcro, or other kinds of fasteners. As described above, inner elastic member may be fixedly attached to outer frame member at some locations but allowed to move relative to outer frame member in other locations. For example, in one embodiment, an inner elastic member could be fixedly attached (e.g., using a hot-melt adhesive) to a rearward portion of an outer frame member, but may not be fixedly attached to the wing portions of the outer frame member. In other cases, the entirety of inner elastic member could be fixed in place relative to an outer frame member.

Any suitable mode of attachment may also be used to secure the heel counter to an article of footwear, including any of the attachment modes described above. The heel counter can be fixedly attached to the heel region and lacing region of an upper, thereby preventing the heel counter from moving relative to the upper. It may be desirable, in some cases, to fix an outer frame member of the heel counter in place while allowing an inner elastic member to move (for example, to stretch). This may be accomplished by fixedly attaching some portions of the outer frame member to the heel region of the upper without attaching the inner elastic member directly to the upper. Instead, in such a configuration, the inner elastic member may be held in place between the outer frame member and the exterior side of the upper, and/or by any direct attachments between the outer frame member and the inner elastic member.

As best seen in FIG. 4, inner elastic member 162 may be exposed through cut-out 165. This arrangement allows for increased flexibility of heel counter 150 at rearward portion 152. Additionally, as discussed below, cut-out 165 provides increased room for inner elastic member 162 to stretch and cup the heel as tension is applied to pull heel counter 150 forward.

Outer frame member 160 and inner elastic member 162 may have distinctive material properties. For example, outer frame member 160 may comprise a first material and inner elastic member 162 may comprise a second material. The second material of inner elastic member 162 may be substantially more elastic than the first material of outer frame member 160. That is, the second material may have a lower elastic modulus than the first material. Because of this difference in elasticity, the second material of inner elastic member 162 may undergo substantially more stretching than the first material of outer frame member 160 when stresses are applied to heel counter 150. For example, while outer frame member 160 may undergo stretching of less than 1% of its length when lengthwise stresses are applied, inner elastic member 162 could undergo stretching of substantially more than 1% of its length under the same lengthwise stresses. As another example, outer frame member 160 may undergo stretching of less than 1% of its length when lengthwise stresses are applied, while inner elastic member 162 may undergo stretching of substantially more than 5% of its length under the same stresses. With this configuration, outer frame member 160 provides a relatively rigid support to help lock the foot in place, while inner elastic member 162 stretches to cradle the heel.

It may be appreciated that while inner elastic member 162 may be substantially more elastic than outer frame member 160, outer frame member 160 may still be flexible. That is, although outer frame member 160 undergoes little stretching in response to forces applied along its length or height, outer frame member 160 may still bend and flex about axes parallel with the exterior surface of heel counter 150. This relative flexibility allows the wing portions of heel counter 150 to adapt to the contours of upper 102 as they extend into fastening region 118 (see FIG. 1).

A heel counter with an inner elastic member and an outer frame member that is less elastic can be made by selecting a suitable combination of materials for each member. For example, an outer frame member may be made from various different materials. Exemplary materials include, but are not limited to: nylon, cotton, natural leather, or synthetic leather. Other exemplary materials include various kinds of plastics, such as thermoplastic polyurethane (TPU). Additionally, an inner elastic member may be made from various different materials. Exemplary materials include, but are not limited to: natural rubber, synthetic rubber, nitrile rubber, silicone rubber, urethane rubbers, chloroprene rubber, Ethylene Vinyl Acetate (EVA), and other materials having high elasticity. Other exemplary materials include various stretch fabrics, such as elastane. In one exemplary embodiment, an outer frame member may be made of a synthetic leather or non-stretchable fabric, while an inner elastic member may be made of a stretchable fabric like elastane.

Heel counter 150 may incorporate eyelets to facilitate tensioning via a lacing system. As shown in FIGS. 2-3, first wing portion 154 and second wing portion 156 may include a first eyelet 180 and a second eyelet 182, respectively. Each eyelet may extend through both inner elastic member 162 and outer frame member 160. As seen in FIG. 3, inner elastic member 162 includes an opening 181 and outer frame member 160 includes an opening 185 associated with first eyelet 180. Likewise, inner elastic member 162 includes an opening 183 and outer frame member 160 includes an opening 187 associated with second eyelet 182. In other cases, each eyelet may be associated with openings in only outer frame member 160 or in inner elastic member 162, but not both. Lace 122 may then be inserted through first eyelet 180 and second eyelet 182, as shown in FIG. 1.

Figure 5:
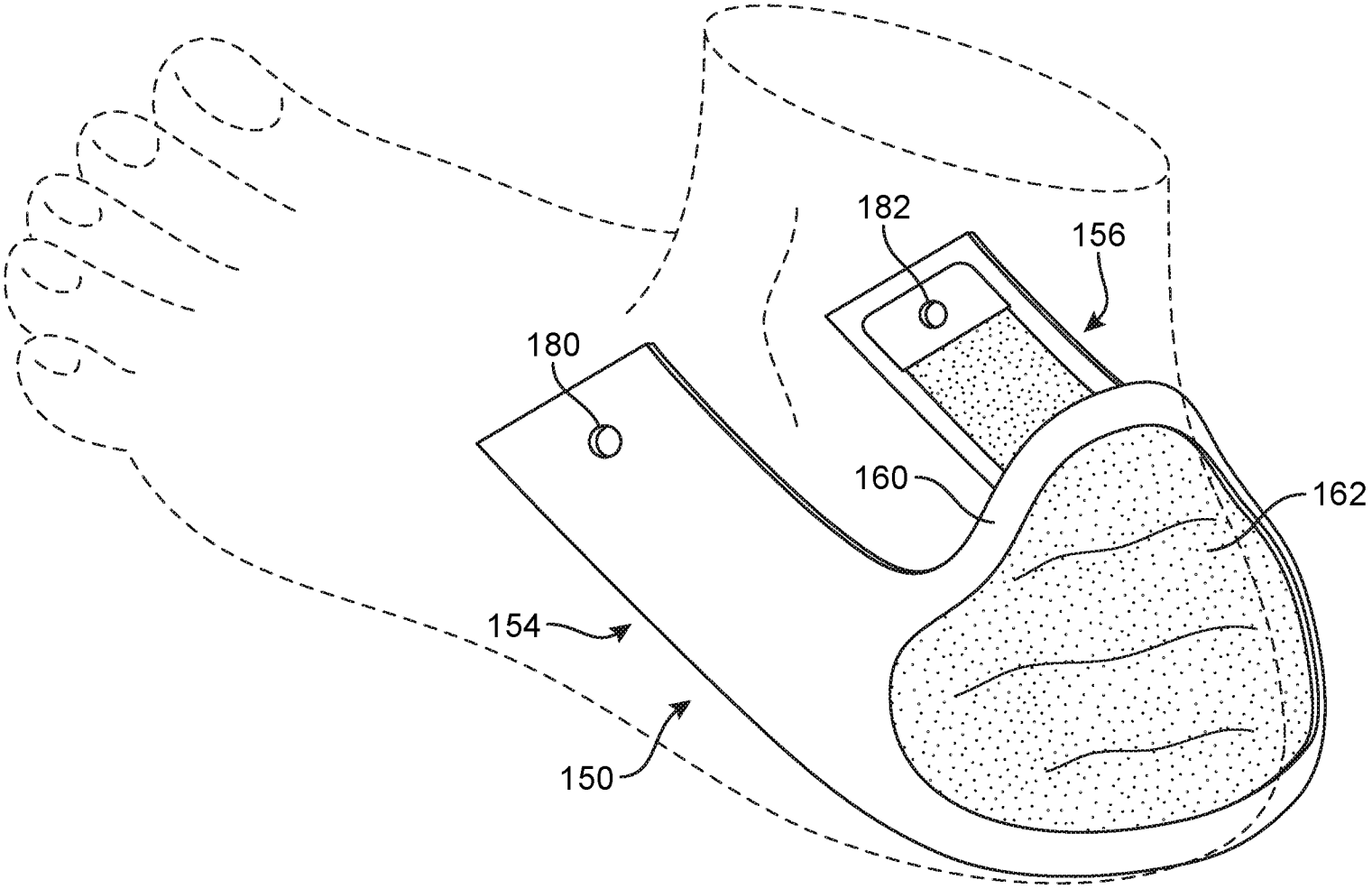
FIG. 5 is a schematic view of a heel counter in position at a heel of a foot in a non-tensioned state, according to an embodiment.
Figure 6:
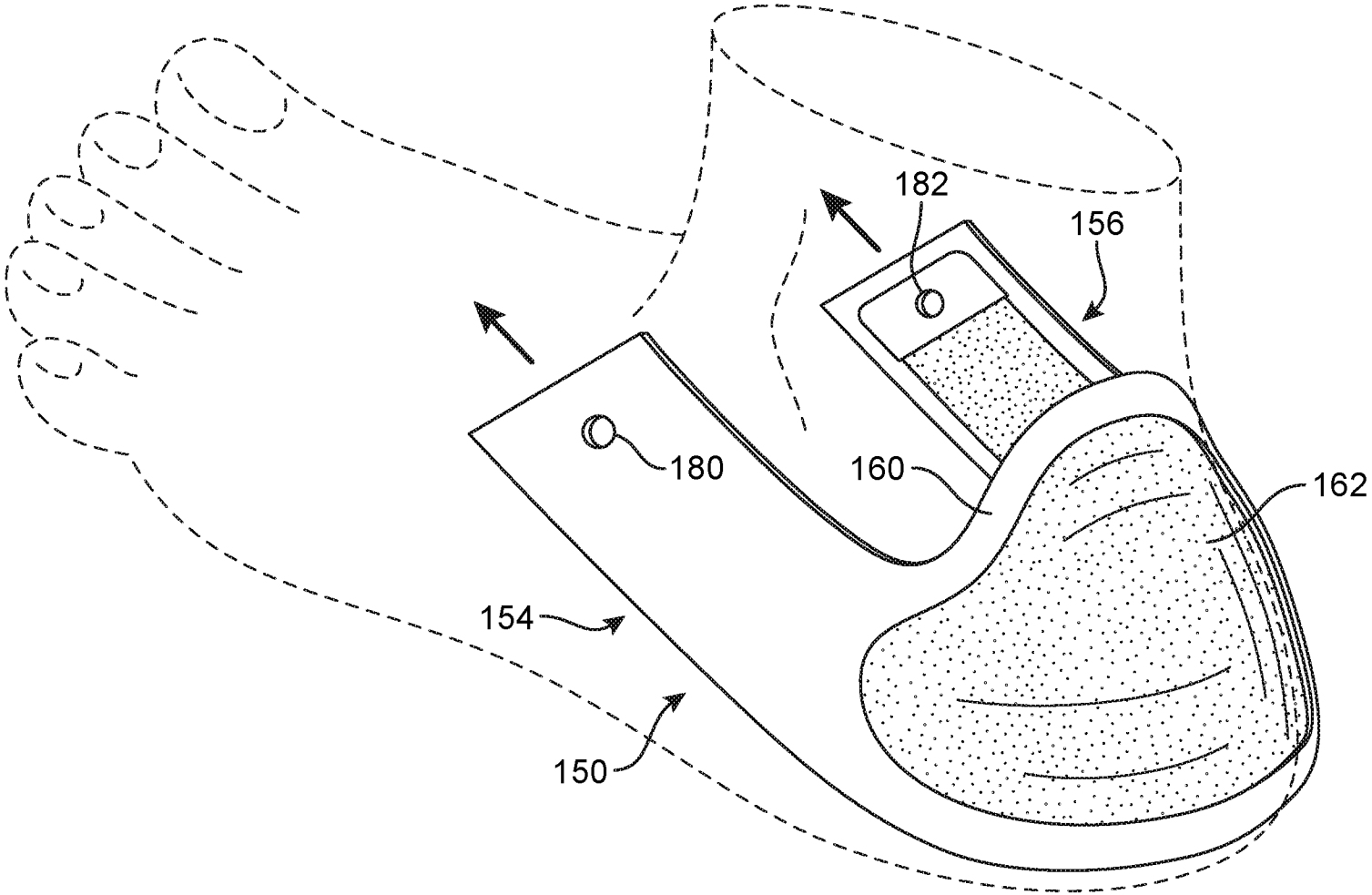
FIG. 6 is a schematic view of the heel counter in FIG. 5 in a tensioned state, according to an embodiment.

This configuration allows tension to be applied directly to first wing portion 154 and second wing porton 156 using a lace. For example, FIG. 5 depicts a schematic view of heel counter 150 in an untightened state. For purposes of clarity, heel counter 150 is shown in isolation, though it may be appreciated that heel counter 150 is disposed on an article (for example, article 100). In this untightened state, inner elastic member 162 may be slack (or, possibly, pre-tensioned). However, as tension is applied to first wing portion 154 and second wing portion 156 by a lace (not shown), heel counter 150 may be pulled forward, as indicated schematically in FIG. 6. As heel counter 150 is pulled forward, outer frame member 160, which is relatively inelastic, may be pulled forward to lock down the heel.

At the same time that outer frame member 160 moves forward, inner elastic member 162 surrounds and cups the heel from all directions. This support is made possible by the presence of cut-out 165, as inner elastic member 162 has room to expand through cut-out 165 as it stretches around and conforms to the heel.

In the exemplary configuration depicted in FIG. 1, the wing portions of heel counter 150 are exposed on the exterior of article 100. However, in other embodiments additional components could be used to partially, or fully, cover the wing portions. In another embodiment, for example, the wing portions could be disposed beneath an outer layer and could extend out of slots on the outer layer adjacent a fastening region.

Figure 7:
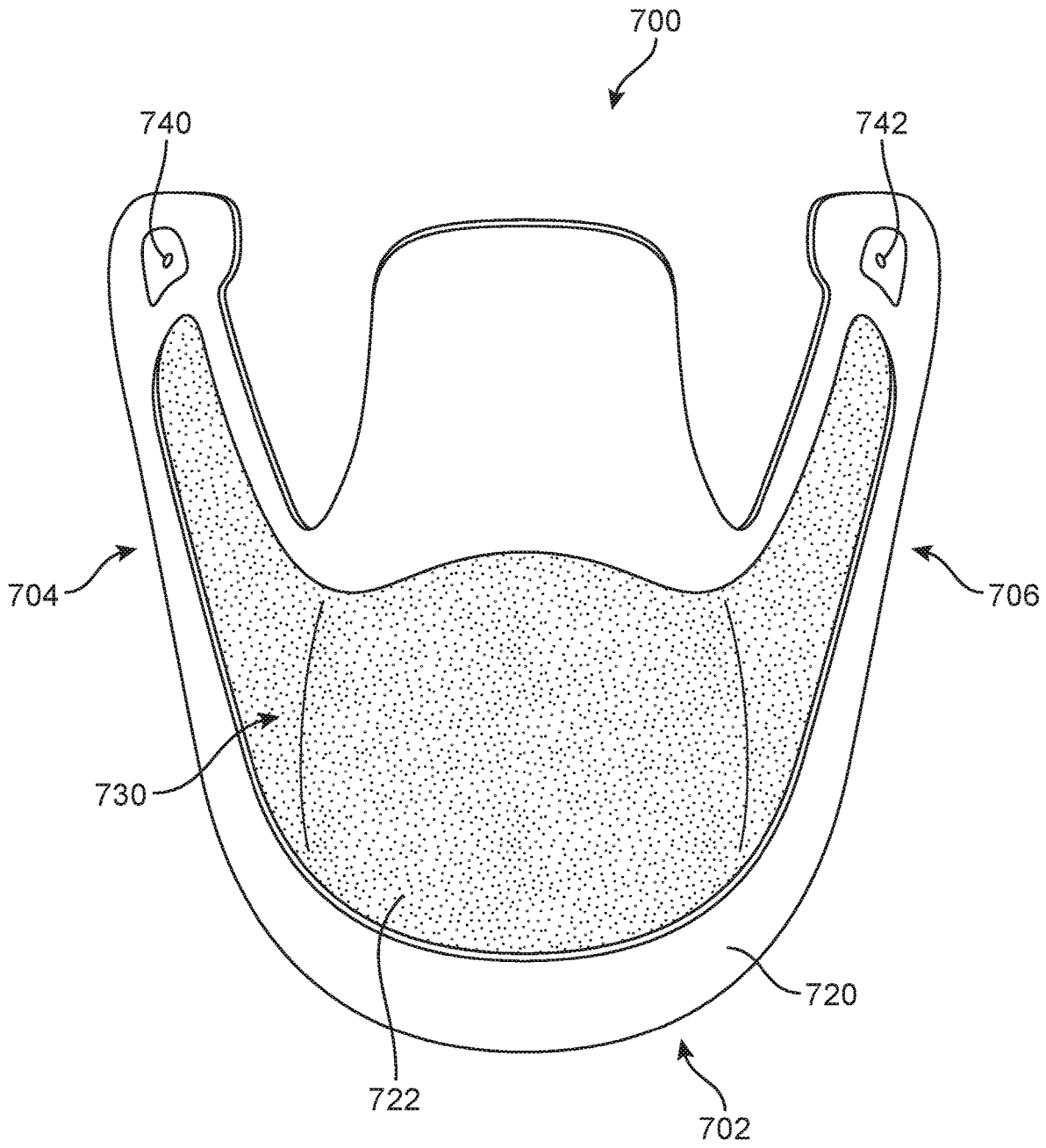
FIG. 7 is a schematic view of another embodiment of a heel counter.

FIG. 7 is a schematic view of another embodiment of a heel counter 700. Heel counter 700 includes a rearward portion 702, a first wing portion 704 and a second wing portion 706. Heel counter 700 also includes an outer frame member 720 and an inner elastic member 722. In contrast with the previous embodiment, outer frame member 720 includes a cut-out 730 that extends through not only rearward portion 702, but also through first wing portion 704 and second wing portion 706. Therefore, inner elastic member 722 is exposed on the exterior of heel counter 700 throughout rearward portion 702, first wing portion 704 and second wing portion 706. Using a larger cut-out (compared to the cut-out of the embodiment described above) may reduce the stiffness of the heel counter by removing a substantial amount of the material that would otherwise comprise an outer frame member. This may also increase the area of the foot that is cupped by inner elastic member 722 as tension is applied.

It may be appreciated that in other embodiments, the size and shape of one or more cut-outs could be selected to achieve a desired degree of flexibility in the outer frame member. Moreover, the shape of a cut-out is not limited to a generally rounded shape. In another embodiment, for example, a cut-out could be provided in the shape of a logo or other indicia.

Heel counter 700 also includes first eyelet 740 and second eyelet 742, disposed at the ends of first wing portion 704 and second wing portion 706, respectively. Specifically, first eyelet 740 may be disposed at an end of first wing portion 704, while second eyelet 742 may be disposed at an end of second wing portion 706. As tension is applied to each of these eyelets, outer frame member 720 may be pulled against the heel as inner elastic member 722 surrounds the heel and cups it.

Heel counter 700 may also include a raised portion 760. Raised portion 760 may extend upwards from rearward portion 702, thereby increasing the overall height of rearward portion 702. Raised portion 760 may provide increased protection to the achilles. Additionally, raised portion 760 may help to lock down the foot by reducing the tendency of the heel to slide up and out of an upper opening as heel counter 700 is pulled forward against the heel.

Figure 8:
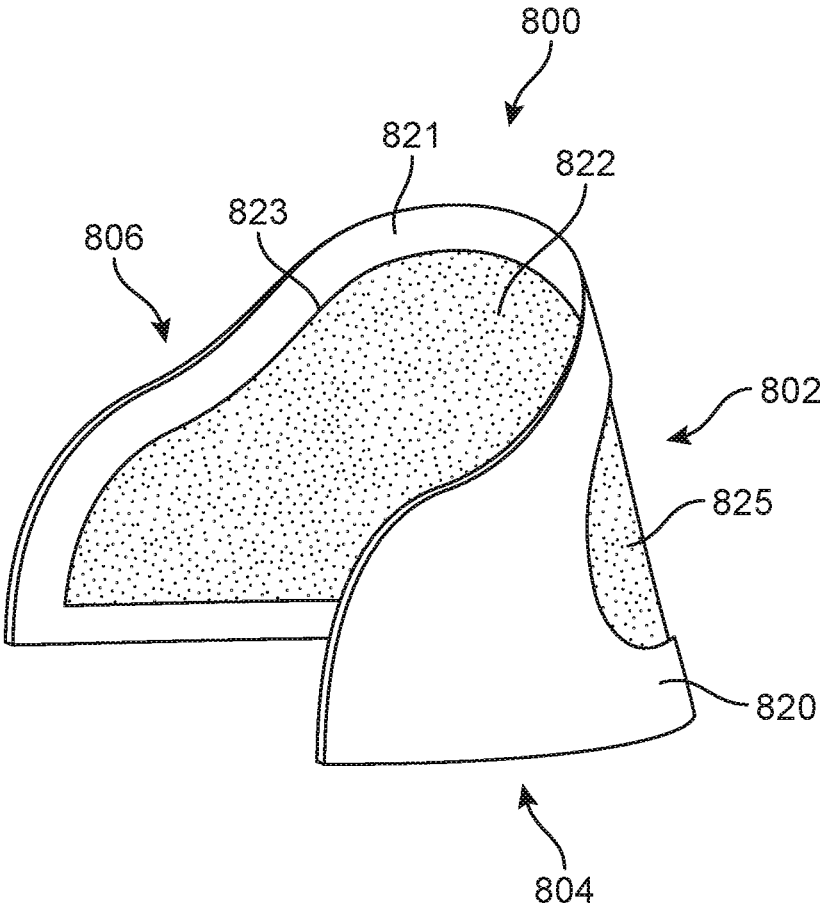
FIG. 8 is a schematic view of another embodiment of a heel counter.

FIG. 8 is a schematic isometric view of another embodiment of a heel counter. Heel counter 800 lacks the wing portions included in the embodiments of FIGS. 1-7. Heel counter 800 includes a rear facing side 802, a first lateral facing side 804 and a second lateral facing side 806. Each side provides support to a part of a heel. Specifically, rear facing side 802 supports the heel from the rear, while first lateral facing side 804 and second lateral facing side 806 act to support the heel from the sides.

Heel counter 800 includes an outer frame member 820 and an inner elastic member 822. An outer edge 823 of inner elastic member 822 may be fixedly attached to the inner periphery 821 of outer frame member 820. Although elastic member 822 may be fixed in place along its outer edge 823, some portions of elastic member 822 may still stretch as forces are applied to heel counter 800. For example, as a heel is pressed back against rear facing side 802 of heel counter 800, a central portion 825 of inner elastic member 822 may stretch to catch the heel and help hold the heel in place in the shoe.

While various embodiments have been described, the description is intended to be exemplary, rather than limiting, and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A heel counter for an article of footwear, the heel counter comprising:

a rearward portion, a first wing portion extending from a first side of the rearward portion, and a second wing portion extending from a second side of the rearward portion;

the heel counter further comprising:

an outer frame member;

an inner elastic member;

wherein the outer frame member includes a rearward portion with a cut-out, and wherein the inner elastic member is exposed through the cut-out;

wherein the first wing portion includes an eyelet that extends through both the inner elastic member and the outer frame member; and wherein the inner elastic member is made of a stretchable fabric and wherein the outer frame member is made of a non-stretchable material.

2. The heel counter according to claim 1, wherein the inner elastic member is fixedly attached to the outer frame member.

3. The heel counter according to claim 1, wherein the inner elastic member expands through the cut-out as the heel counter is pushed against a heel.

4. The heel counter according to claim 2, wherein the cut-out in the rearward portion of the outer frame member includes a periphery extending around the cut-out; and wherein the inner elastic member is fixedly attached to the outer frame member only along the periphery of the cut-out.

5. The heel counter according to claim 4, wherein the inner elastic member is pre-tensioned prior to being fixedly attached to the periphery of the cut-out.

6. The heel counter according to claim 1, wherein the outer frame member and the inner elastic member have similar shapes.

7. The heel counter according to claim 1, wherein the cut-out in the outer frame member extends continuously through the first wing portion, the rearward portion and the second wing portion.

8. The heel counter according to claim 7, wherein the inner elastic member is exposed through the cut-out in the first wing portion, the rearward portion and the second wing portion.

9. An article of footwear, comprising:

an upper;

a sole structure attached to the upper;

a heel counter disposed on an exterior of the upper in a heel region, the heel counter further comprising an outer frame member and an inner elastic member;

wherein the outer frame member includes a rearward portion with a cut-out, and wherein the inner elastic member is exposed through the cut-out;

wherein the heel counter includes an uppermost edge disposed beneath an opening of the upper configured to receive a foot and a lowermost edge disposed above the sole structure;

wherein the inner elastic member is substantially more elastic than the outer frame member;

wherein the upper includes a lacing region;

wherein the heel counter includes a rearward portion, a first wing portion extending from a first side of the rearward portion, and a second wing portion extending from a second side of the rearward portion, wherein the first wing portion includes a first eyelet and wherein the second wing portion includes a second eyelet;

wherein the first wing portion extends from the heel region to the lacing region; and wherein the second wing portion extends from the heel region to the lacing region.

10. The heel counter according to claim 9, wherein the heel counter includes an inward facing side and an outward facing side, the outward facing side being exposed on the exterior of the article of footwear, and wherein a portion of the inner elastic member is covered by the outer frame member on the outward facing side.

11. The heel counter according to claim 9, wherein the outer frame member and the inner elastic member have similar shapes.

12. The heel counter according to claim 9, wherein the outer frame member is configured to undergo stretching of less than 1% of its length when a lengthwise stress is applied; and wherein the inner elastic member is configured to undergo stretching of more than 5% of its length when the same lengthwise stress is applied.

13. The heel counter according to claim 9, wherein the first eyelet extends through the inner elastic member and the outer frame member; and wherein the second eyelet extends through the inner elastic member and the outer frame member.

14. An article of footwear, comprising:

an upper and a lace extending through openings in a lacing region of the upper;

a sole structure attached to the upper;

a heel counter disposed on an exterior of the upper in a heel region located between an opening of the upper configured to receive a foot and the sole structure, the heel counter further comprising a rearward portion for receiving a heel, a first wing portion extending from a first side of the rearward portion, and a second wing portion extending from a second side of the rearward portion;

the heel counter including an outer frame member and an inner elastic member;

the first wing portion including a first eyelet that extends through the inner elastic member and the outer frame member;

the second wing portion including a second eyelet that extends through the inner elastic member and the outer frame member;

wherein the first wing portion extends to the lacing region and wherein the lace extends through the first eyelet; and wherein the second wing portion extends to the lacing region and wherein the lace extends through the second eyelet.

15. The article of footwear according to claim 14, wherein the inner elastic member is made of a stretchable fabric and wherein the outer frame member is made of a non-stretchable material.

16. The article of footwear according to claim 15, wherein the inner elastic member extends through the rearward portion, the first wing portion and the second wing portion, and wherein the outer frame member extends through the rearward portion, the first wing portion and the second wing portion.

17. The article of footwear according to claim 15, wherein the outer frame member includes a cut-out and wherein the inner elastic member is exposed through the cut-out.

18. The article of footwear according to claim 17, wherein the cut-out in the outer frame member includes a periphery extending around the cut-out; and wherein the inner elastic member is fixedly attached to the outer frame member only along the periphery of the cut-out.

19. The article of footwear according to claim 14, wherein a height of the heel counter tapers from the rearward portion to the first wing portion.

20. The article of footwear according to claim 19, wherein the height of the heel counter tapers from the rearward portion to the second wing portion.

* * * * *